US006446618B1

(12) United States Patent
Hill

(10) Patent No.: US 6,446,618 B1
(45) Date of Patent: Sep. 10, 2002

(54) PURGE FUEL FLOW RATE DETERMINATION METHOD

(75) Inventor: Raymond John Hill, Beldon (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 0 days.

(21) Appl. No.: 09/787,417

(22) PCT Filed: Sep. 30, 1999

(86) PCT No.: PCT/AU99/00837

§ 371 (c)(1),
(2), (4) Date: Mar. 22, 2001

(87) PCT Pub. No.: WO00/19083

PCT Pub. Date: Apr. 6, 2000

(30) Foreign Application Priority Data

Sep. 30, 1998 (AU) ..... PP6270

(51) Int. Cl.[7] ..... F02M 25/08
(52) U.S. Cl. ..... 123/698; 123/519; 123/533
(58) Field of Search ..... 123/516, 518, 123/519, 520, 531, 533, 698

(56) References Cited

U.S. PATENT DOCUMENTS

| | | | | |
|---|---|---|---|---|
| 5,245,974 A | | 9/1993 | Watson et al. | 123/518 |
| 5,596,972 A | | 1/1997 | Sultan et al. | 123/520 |
| 5,696,317 A | | 12/1997 | Rychlick | 73/118.1 |
| 5,918,580 A | * | 7/1999 | Hennrich et al. | 123/520 |
| 5,931,141 A | * | 8/1999 | Chino | 123/520 |
| 6,014,958 A | * | 1/2000 | Miwa et al. | 123/520 |
| 6,305,360 B1 | * | 10/2001 | Hurley | 123/520 |

FOREIGN PATENT DOCUMENTS

DE 196 17 386 C1 4/1996

* cited by examiner

*Primary Examiner*—Tony M. Argenbright
(74) *Attorney, Agent, or Firm*—Arent Fox Kintner Plotkin & Kahn PLLC

(57) ABSTRACT

A method of determining a purge fuel mass flow rate from a fuel vapor control system to an internal combustion engine having a compressor for delivering purge gas from the fuel vapor control system to the engine. The temperature rise of the purge gas passing through the compressor is determined. Then, a specific heat ratio of the purge gas is determined as the function of the temperature rise. The purge fuel mass flow rate is determined as a function of specific heat ratio of the purge gas.

17 Claims, 3 Drawing Sheets

PURGE FUEL FLOW RATE DETERMINATION METHOD

The present invention generally relates to the control of fuel vapour generated within an internal combustion engine installation, and in particular to a method for determining the amount of fuel vapour purged from a fuel vapour collection device of the engine installation.

The current emission regulations in many countries require the evaporative emissions from the fuel supply system of the internal combustion engines of motor vehicles to be controlled to thereby eliminate or substantially reduce the amount of fuel released into the atmosphere by such vapours. Accordingly, it is normal practice to fit a fuel vapour collection device to the vehicle to adsorb evaporative emissions from the fuel supply system under all conditions that the vehicle experiences. This fuel vapour collection device is usually of the activated carbon type and is commonly referred to as the "carbon canister". Such a fuel vapour collection device operates on the principle of physical adsorption of fuel vapour onto the activated carbon.

The fuel vapour collection device generally has a limited capacity for storing fuel vapour and must therefore be purged to some extent of its contents in the course of vehicle operation. The accumulated fuel vapour is normally purged into the intake manifold of the engine by way of air drawn through the fuel vapour collection device, the purged fuel vapour being subsequently combusted within the engine. The amount of fuel vapour being purged from the fuel vapour collection device can however vary significantly for any given purge air flow rate generally depending on the saturation level in the fuel vapour collection device. As the amount of purged fuel vapour is typically not able to be measured in systems not having an air/fuel ratio feedback mechanism (commonly known as open loop systems), the engine control system for such open loop systems generally cannot compensate for the increased fuelling rate to the engine. This can cause an increase in the engine torque which may result in a higher engine speed at idle or an increase in the vehicle speed off idle. Under severe conditions, the engine operation can become unstable because the actual air fuel ratio within the engine cylinders is markedly different from the air fuel ratio mapped by the engine control system.

In the Applicant's U.S. Pat. No. 5,245,974 there is described a fuel vapour control system for an internal combustion engine, the details of which are incorporated herein by reference. This document discloses an internal combustion engine installation having a fuel vapour collection device for removing the fuel vapour from the evaporative emissions generated within the fuel supply system. The engine includes a dual fluid fuel injection system with an air compressor supplying compressed air to the fuel injection system. The fuel vapour collection device is periodically purged of accumulated fuel vapour by way of drawing air through the fuel vapour collection device using the air compressor. The air compressor then supplies the air which now carries the fuel vapour to the fuel injection system where the air is subsequently injected into the combustion chambers of the engine resulting in combustion of the purged fuel vapour. Although the stratification within the cylinder will remain largely unaltered by the addition of the purged fuel through the injector, this patent does not particularly address the problem of lack of knowledge of the amount of fuel being supplied from the fuel vapour collection device.

A proposal for dealing with this problem is described in the Applicant's International Publication No. WO 00/01663, the details of which are also incorporated herein by reference. This document describes a method of controlling the flow rate of a purge flow passing through a fuel vapour collection device by controlling the opening of a flow control valve located between the vapour collection device and the engine. The method controls the flow control valve as a function of engine operating conditions. However, the described method does not actually determine the amount of fuel vapour in the purge flow to the engine. An iterative method for providing an estimation of the fuel flow rate based on empirical data is actually used. This application also describes a method of determining the amount of fuel vapour being purged during closed loop operation of the engine. The engine is typically operated in this manner when the engine is at idle. It may also be possible to operate the engine under closed loop control when operating at stoichiometric air/fuel ratio conditions. However, at other engine loads such as at partial loads, it is necessary to operate the engine under open loop control where the fuel purge flow rate cannot be directly determined.

It would therefore be advantageous to be able to determine the actual amount of fuel within the purge flow to the engine under most, if not all engine operating conditions.

With this in mind, an object of the present invention is to provide an improved method for determining a purge fuel mass flow rate from a fuel vapour control system to an internal combustion engine, at least under most engine operating conditions.

According to the present invention, there is provided a method for determining a purge fuel mass flow rate from a fuel vapour control system to an internal combustion engine having a compressor for delivering purge gas from the fuel vapour control system to the engine, the method including:

- determining the temperature rise of the purge gas passing through the compressor;
- determining the specific heat ratio of the purge gas as a function of the temperature rise; and
- determining the purge fuel mass flow rate as a function of the specific heat ratio of the purge gas.

Preferably, the fuel vapour control system includes an air/fuel separation means for collecting fuel vapour generated within the engine. Preferably, the compressor is arranged to deliver purge gas from the air/fuel separation means to the engine. It is however contemplated that the compressor may deliver to the engine purge gas or fuel vapour generated or present anywhere within the engine.

As the purge fuel mass flow rate is determined as a function of the temperature rise of the purge gas as it passes though the compressor, the determination of the purge fuel mass flow rate is independent of the engine operating conditions. Therefore, the purge fuel mass flow rate can be determined under most, if not all engine loads and speeds.

The specific heat ratio of the purge gas varies in dependence on the purge fuel concentration of the purge gas. Further, the specific heat ratio of purge fuel is significantly different from the specific heat ratio of air. For example, the specific heat ratio of air is about 1.4, whereas typical purge fuel species such as $C_3H_8$, $C_4H_{10}$, and $C_5H_{14}$ have specific heat ratios of between 1.06 to 1.11. Generally, the higher the molecular weight of the gas, the lower the value of the specific heat ratio.

Therefore, as the concentration of purge fuel or fuel vapour within the purge gas increases, the specific heat ratio of the purge gas decreases. Hence, by monitoring the change in the adiabatic temperature rise of the gas passing through the compressor, the purge fuel mass flow rate may be determined. That is, as the compressor goes from delivering solely air to the engine to delivering both air and purge fuel, the specific heat ratio of the gas passing through the compressor will change.

Most positive displacement compressors provide approximately adiabatic compression of gas passing through the compressor. However, the compressor can never provide truly adiabatic compression under actual operating conditions due to heat losses within the compressor and in general a real compressor provides compression which is neither adiabatic nor isothermal. It can be modelled however by using the polytropic compression equation:

$$T_{OUT}=T_{IN}\times PR^{n1(n-1)}$$

where $T_{OUT}$ is the compressor discharge temperature;

$T_{IN}$ is the compressor inlet temperature;

PR is the pressure ratio across the compressor; and n is the polytropic index.

The polytropic index for positive displacement compressors using air as the fluid being delivered is typically 1.3. If the compressor was ideal and provided adiabatic compression, then $n=C_p/C_v$ (the specific heat ratio of the purge gas) which equals 1.4 for air. The difference reflects the fact that the compressor is not perfect and does have losses.

For a compressor which has a gas of variable composition passing through it, the above equation may be modified as follows:

$$T_{OUT} = T_{IN} \times PR^{k\left(\frac{\gamma}{\gamma-1}\right)}$$

where $\gamma$ is the specific heat ratio ($C_p/C_v$) for the mixture.

The value k reflects the fact that it is a real process and therefore allows for losses to occur. The value of k may be determined for a particular compressor. Hence the specific heat ratio of the purge gas passing through the compressor may be determined by the following equation:

$$T_{OUT} = T_{IN} \times PR^{k}\left(\frac{C_p/C_v}{(C_p/C_v-1)}\right)$$

As the pressure ratio across the compressor is generally constant, the specific heat ratio of the purge gas can be determined by measuring the compressor discharge temperature. This temperature can for example be measured by a temperature sensor such as a thermistor located downstream of the discharge port of the compressor. In the Applicant's engine installations, the air inlet temperature is generally measured at the air inlet or intake manifold for engine control purposes. The compressor inlet temperature can essentially be set as being the same as the temperature of the air at the intake manifold, with any temperature increase of the air between the intake manifold and the compressor inlet being likely to be minimal. It is however also envisaged that a further temperature sensor could be provided immediately upstream of the compressor intake for greater accuracy.

An average discharge temperature may be determined by electronically filtering the signal from the temperature sensor. Alternatively, the temperature sensor may be placed a sufficient distance away from the compressor discharge port. It is also preferable for a temperature sensor having a relatively low dynamic response to be used to thereby avoid the need to further dampen the signal from the sensor.

As mentioned above, the compressor does not produce a truly adiabatic compression process due to heat losses to the compressor components and housing surrounding the compression chamber of the compressor. For example, in the case of a piston compressor, heat losses may occur to the cylinder wall, the compressor head and the compressor piston. The method according to the present invention may therefore include compensation means to account for the effect of the abovenoted heat losses by monitoring the coolant temperature of the engine and adding a compensation factor to the abovenoted determination. For example, the difference in the coolant temperature between the nominal value at which a calibration was done and the actual value at current engine operating conditions could be measured and simply added as an offset.

The heat loss per compressor cycle will typically also be inversely proportional to the operational speed of the compressor. To this end, the method may further include mapping or calculating the heat loss at different compressor speeds. For example, a series of tests could be done on a compressor installation from which an experienced relationship could be developed to reflect the variation with compressor speed. It should also be noted that the compressor speed has a direct effect on the temperature rise across the compressor and therefore a suitable compensation factor may also be required to take into account changes in the compressor speed. Such a compensation factor could either be mapped or have a suitable algorithm determined therefore. In essence the simplest approach would be to have a look-up map which provides compensation for compressor speed as this would automatically allow for the heat loss per compressor cycle varying with compressor speed.

As noted above, the inlet temperature to the compressor intake can be assumed to be equal to the temperature of the air at the engine intake. If the inlet temperature variations are likely to be significant, then a non-linear compensation for the intake temperature could be provided in the form of a further calculation or by the inclusion of a compensation look-up map provided in an ECU of the engine.

The compressor temperature characteristics may alter over time because of degradation of the compressor performance due to, for example, ring wear, valve leakage and so on. This may progressively decrease the accuracy of the purge fuel mass flow rate determination. Furthermore, the pressure ratio will change if there is a restriction to the compressor intake gas flow. This can arise due to, for example, a dirty air filter.

When the engine is operating under closed loop fuelling control (ie: typically at idle or at stoichometric combustion conditions), the purge fuel per cycle to the engine can be measured by alternative means. For example, such a system is disclosed in the Applicant's U.S. Pat. No. 5,806,304, the contents of which are included herein by reference. To this end, the method of the present invention may include comparing the purge fuel mass flow rate determined during closed loop fuelling control with the purge fuel mass flow rate determined by the method according to the present invention. This enables the determination method to be checked for accuracy and adjusted or adapted as required. For example, such an approach could be used to allow for compensation for slightly different fuel vapour compositions due to different grades of fuel (eg. ULP vs PULP vs Super, different RVP's), variations from refineries (typically quite small), and variations in conditions which produce the vapour. The actual change in heat capacity ratios arising from such variations is not expected to be very significant (eg: around 5% maximum), but in the interests of greater accuracy, these could be taken into account if desired. Such a comparison routine could also for example, counter the effect produced by a restriction in the intake of the compressor or by mechanical degradation of the compressor.

Under certain circumstances or in relation to particular engine applications, the method according to the present invention may be used together with other known purge fuel mass flow rate determination means to calculate the purge fuel mass flow rate across all regions of engine operation. For example, under closed loop fuelling control operation, either of the methods alluded to hereinbefore may be used to calculate purge fuel mass flow rate, whilst for operation say during partial load (ie: generally open loop fuelling control), the method according to the present invention could be used to determine purge fuel mass flow rate.

The method according to the present invention has significant practical advantages over known purge fuel mass flow rate control methods. In particular, with respect to the Applicant's International Publication No. WO 00/01663, the method according to the present invention can eliminate the need for the flow control valve and the associated system used to control and drive the control valve. This can result in significant cost savings. The method of the present invention is a comparatively low cost system in that it mainly relies on a low cost thermistor at the compressor outlet as the primary additional hardware. Furthermore, because the purge fuel mass flow rate is being continuously determined, there is no need to attempt to predict this mass flow rate as in the method described in the abovenoted international application. That is, the purge fuel mass flow rate determination method according to the present invention essentially provides for closed loop fuel vapour purge operation for all engine operating conditions.

The method according to the present invention is particularly applicable for four stroke engines having a fuel vapour control system including an air/fuel separation means and a compressor for delivering purged gas from that separation means to the engine. It is however also possible for the method to be used on a two stroke engine having a similar fuel vapour control system.

Conveniently, the compressor forms part of a dual fluid fuel injection system for the engine wherein metered quantities of fuel are delivered to the engine entrained in gas, typically air, supplied by the compressor. Such a dual fluid fuel injection system is for example disclosed in the Applicant's U.S. Pat. No. 4,934,329, the contents of which are included herein by reference. Conveniently, the fuel injection system is configured such that the fuel entrained in air is delivered directly into the combustion chamber(s) of the engine. Hence, any purge fuel or gas delivered to the engine by way of the compressor will be delivered directly into the combustion chamber(s) of the engine.

Conveniently, where the fuel injection system may include air pressure regulation means for dumping excess air that is delivered by the compressor, the method may be sophisticated enough to compensate for any fuel vapour which is recirculated back through the compressor. For example, an air pressure regulator may be configured to dump excess air delivered by the compressor under certain running conditions back to the engine air intake or the intake of the compressor. Hence, if a quantity of fuel vapour was to be purged through the compressor during such running conditions, some of the fuel vapour would be delivered to the engine together with the air delivered by the compressor whilst some of the fuel vapour would invariably be recirculated with the excess air returned by the air pressure regulator. However, as it would typically be possible to determine the volume of air delivered by the fuel injection system delivery injectors to the engine, it would equally be possible to determine the volume of the air and fuel vapour mix actually delivered to the engine. Therefore the volume of air and fuel vapour regulated by the air pressure regulator back into the engine air intake or compressor intake could be determined. The method according to the present invention could hence be arranged to compensate on the basis of any such recirculated fuel vapour (eg. air pressure regulation compensation factor) so as to maintain the accuracy of the determination of purge fuel mass flow rate.

In certain applications, the fuel injection system may be configured to allow for throttling of the intake of the air compressor to improve the efficiency of the overall system. However, throttling of the compressor intake also has the effect of changing the pressure ratio across the compressor (ie. PR may not necessarily be constant). Conveniently, the system is able to compensate for such variable PR values such that an accurate determination of the purge fuel mass flow rate may be made. For example, a suitable compensation factor could be determined by a method of calculation or a method of measurement.

To enable compensation by way of measurement, a suitable pressure sensor may be provided at the compressor intake to determine the throttled air pressure. That is, a measurement of the air pressure downstream of a particular throttling means which is used (eg. a suitable butterfly valve in the compressor intake passage) is made. A further air pressure sensor may then be provided downstream of an outlet of the compressor and the readings from each sensor compared in order to determine the pressure ratio across the compressor due to a particular degree of throttling. Alternatively, rather then provide a second air pressure sensor downstream of the compressor outlet, if the air pressure downstream of the compressor is being regulated to a predetermined value (eg. one necessary for satisfactory operation of the fuel injection system), the reading from the first sensor may be compared to this fixed value in order to determine the pressure ratio across the compressor for the particular degree of throttling applied.

To enable compensation via a method of calculation, the relationship between the degree of throttling of the compressor intake and the pressure ratio across the compressor could simply be mapped at the point at which the. engine is initially calibrated. This information can then be used to create an appropriate lookup table such that during operation of the engine, an engine control system is able to use the lookup table to determine a PR value corresponding to any degree of throttling which is applied via the throttling means Hence, by way of either of these methods, a suitable PR value can be calculated for a certain degree of throttling of the compressor intake and this PR value can be used to enable accurate determination of the purge fuel mass flow rate.

It will be convenient to further describe the invention by reference to the accompanying drawings which show one possible arrangement of a fuel vapour control system using the method according to the present invention.

Figure 1:
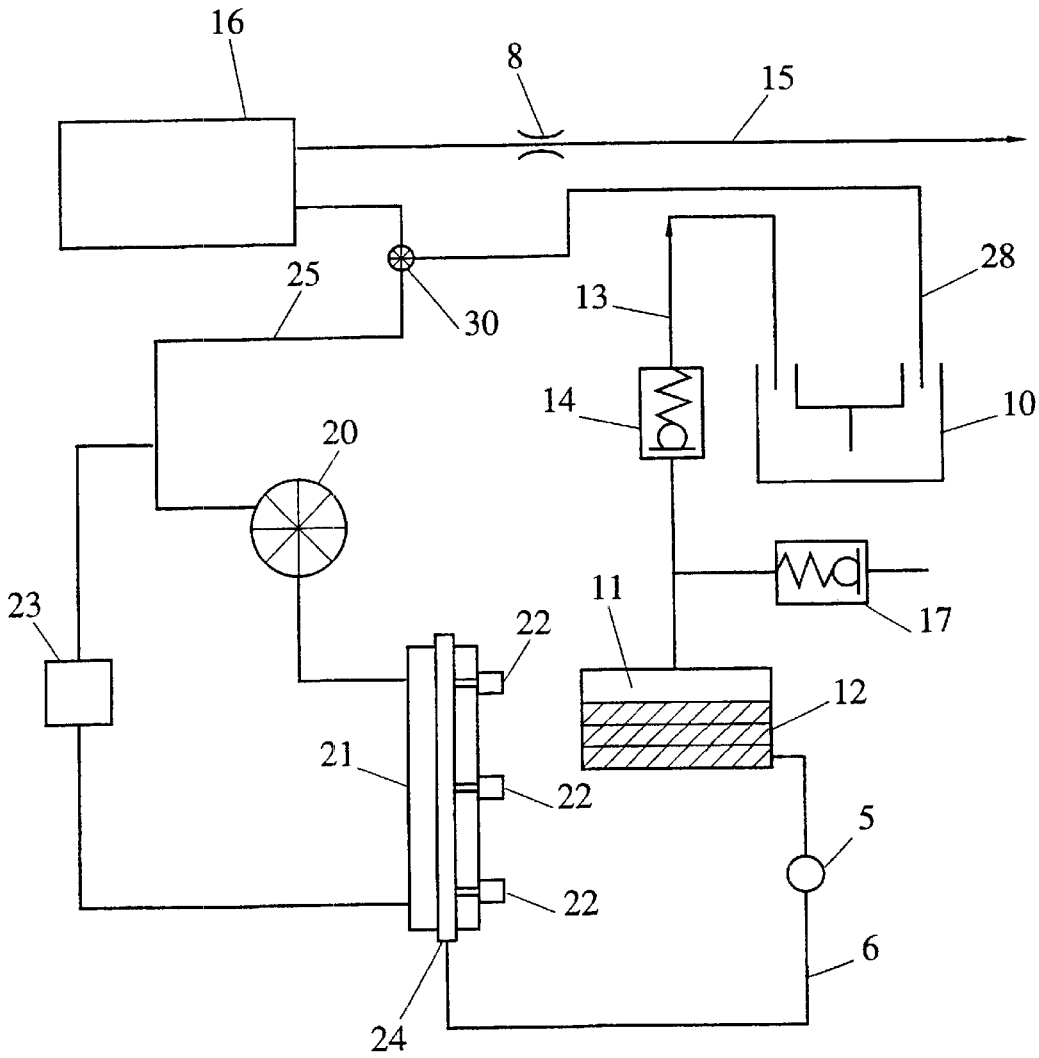
FIG. 1 is a diagrammatic layout of a fuel vapour control system according to the present invention.

The fuel vapor control system shown in FIG. 1 and the method according to the present invention can be used on four stroke engines. This method is however also equally applicable for use on two stroke engines.

The system includes an air/fuel separator 10. Such separators 10 typically comprise a filter medium of activated carbon. The input side of the separator 10 typically communicates with the vapour space 11 in a fuel tank 12 of the engine (not shown) via a conduit 13. A check valve 14 is located in the conduit 13 and is set so as to open and emit a flow of fuel vapour from the fuel tank 12 to the separator 10 when the pressure of the fuel vapour in the fuel tank 12 is above the pressure in the separator 10 by a predetermined amount. A further check valve 17 communicates through the conduit 13 with the vapour space 11 in the fuel tank 12, and is set to open if the pressure in the fuel tank 12 falls below atmospheric.

An air induction passage 15 extends from an air box 16 to the engine. A throttle valve 8 is located in the air induction passage 15 downstream of the air box 16 to control the air flow to the air induction system of the engine in the conventional manner.

The dual fluid fuel injection system for supplying fuel to the engine includes a fuel rail 24, and an air rail 21 for respectively supplying fuel and compressed gas to injectors 22 for injecting fuel entrained in air into each of the cylinders of the engine. The fuel tank 12 is in communication with the fuel rail 24 through a fuel line 6. A fuel pump 5 along the fuel line 6 pumps the fuel to the fuel rail 24 and the fuel pressure within the fuel rail 24 may be regulated by way of a fuel pressure regulator (not shown) arranged with respect to the fuel rail 24 in the normal manner.

Pressurised gas is delivered to the air rail 21 by a compressor 20 which draws air through an air supply conduit 25 connected to the air box 16. An air regulator 23 controls the pressure of air in the air rail 21 in the normal manner. The air regulator 23 may, as alluded to hereinbefore be arranged to dump excess air delivered by the compressor 20 under certain running conditions back to a point in the air conduit 25 upstream of the compressor 20 or into the air induction passage 15 upstream of the engine air induction system.

The outlet side of the separator 10 communicates via a conduit 28 with the air supply conduit 25. By way of a valve 30, the compressor may also draw air through the vapour separator 10. That is, when the valve 30 is opened, the compressor 20 can draw air from the engine air box 16 and through the separator 10 via conduit 28 to thereby purge any fuel vapour accumulated in the separator 10.

The method according to the present invention makes use of the temperature rise due to compression of the purged gas or fuel vapour in the compressor 20 to thereby determine the purge fuel mass flow rate to the engine. This is because the specific heat ratios of air and of fuel vapour are significantly different. That is, because the pressure ratio of the compressor 20 is known, it is possible to determine the ratio of fuel vapour to the air passing through the compressor 20. The specific heat ratios for the following different gas types are as follows:

| Gas Type | $C_p/C_V$ |
|---|---|
| Mono-atomic gases (i.e. Ar, Ne, Kr) | 1.67 |
| Di-atomic gases ($N_2$, $O_2$, air . . . ) | 1.40 |
| Tri-atomic gases ($H_2O$ . . . ) | 1.31 |
| Typical CVP vapour species ($C_3H_8$, $C_4H_{10}$, $C_5H_{12}$, $C_6H_{14}$ . . . ) | 1.06–1.11 |

Generally the higher the molecular weight of the gas the lower the value of $C_p/C_v$. For heavy gases the value approaches 1.

The purge gas mixture draw from the vapour separator 10 is typically dominated by the lighter species, with butane, pentane and hexane comprising typically around 90% of the mix (depending on the gasoline grade and the temperature). The higher molecular weight gases, which are also present, have much lower mass fractions than these and therefore have a much less significant effect on the total mixture heat capacity. Hence, generally it can be stated that the purge gas mixture will have a value of approximately 1.1 for $C_p/C_v$.

Figure 2:
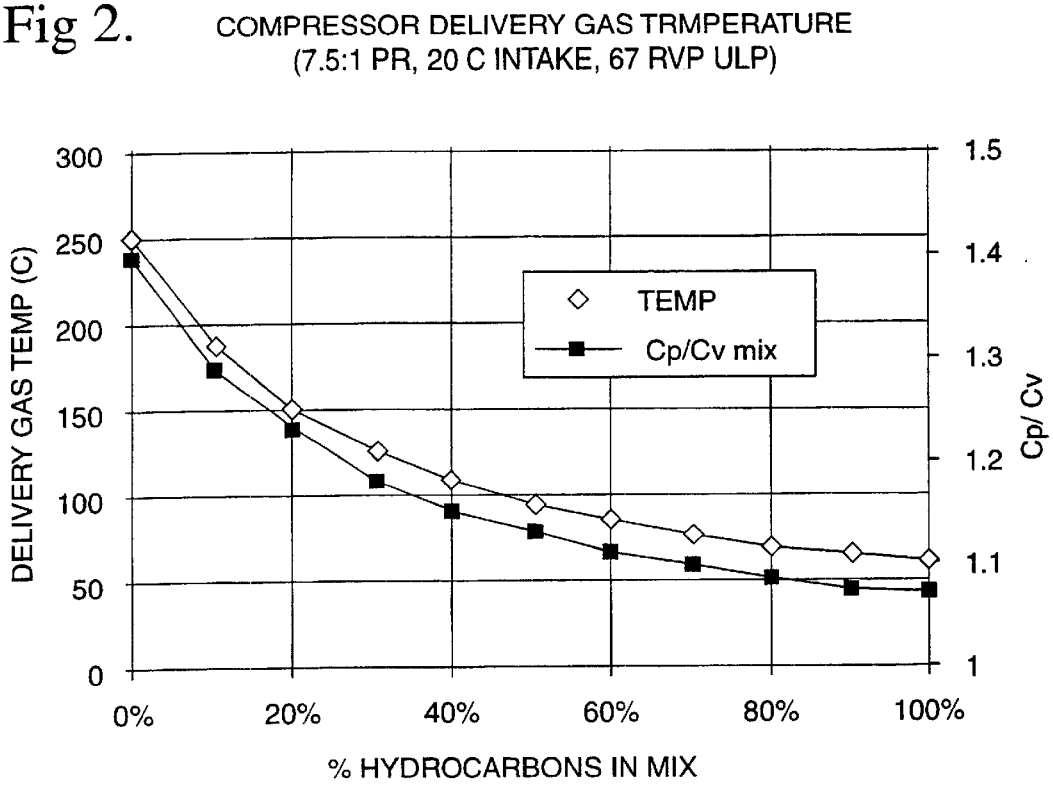
FIG. 2 is a graph showing the calculated percentage of hydrocarbons in a purge gas mixture as a function of the delivery gas temperature.

FIG. 2 shows the theoretical relationship between the percentage of hydrocarbons in the purged gas mixture, and the delivery gas temperature from the compressor 20. The graph was determined based on the following parameters:

- the compressor 20 is sized such that it will deliver approximately 5 mg of air per injection event to the engine; and
- the fuel vapour control system will be set up to deliver as a maximum approximately 50% of the fuelling requirement at idle.

For a typical 4 cylinder, direct injected, 4 stroke engine of around 1.5 to 2 L capacity, this is therefore:

$$2.5[\text{mg/cycle}]\times 850[\text{rpm}]\times 2[\text{events/rev}]=4.25[\text{g/min}]\ \text{hydrocarbon flow}$$

Hence, there will at idle be at maximum approximately a 50:50 mix by mass of fuel vapour and air passing through the compressor 20 when the fuel vapour control system is active (ie: valve 30 is opened). Given this level of hydrocarbon present, it is clearly seen there will be significant changes in the ratio $C_p/C_v$, for the mixture.

Typically, for the applications currently dealt with such as the dual fluid fuel injection system of FIG. 1, the air system is regulated to a pressure of 750 kPa (absolute). If an intake pressure of 100 kPa at the compressor inlet is assumed, then by definition the compressor pressure ratio will be 7.5:1. The temperature rise due to compression of the gas mix in passing through the compressor 20 is then given by:

$$T_{out}=T_{in}\times PR^{\cdot}(C_p/C_v/\{C_p/C_v-1\})k$$

Since $T_{in}$ is absolute, small temperature changes of 10 or 20 C will not make a large change in the result. Hence, the dominant effect on the temperature rise will be the specific heat ratio of the purge gas. For the condition outlined above a plot of this relationship as a function of the mass fraction of fuel vapour present is shown in FIG. 2. An inlet temperature of 293 K and pressure ratio, PR, of 7.5 was used.

Noteworthy is the significant variation in the mixture for the value of $C_p/C_v$. which as a direct result changes the temperature of the gas delivered from the compressor 20. It is apparent that when the mixture is changed from 100% air to a 50:50 fuel vapour air mix that the temperature falls by approximately 170 degrees C.

Figure 3:
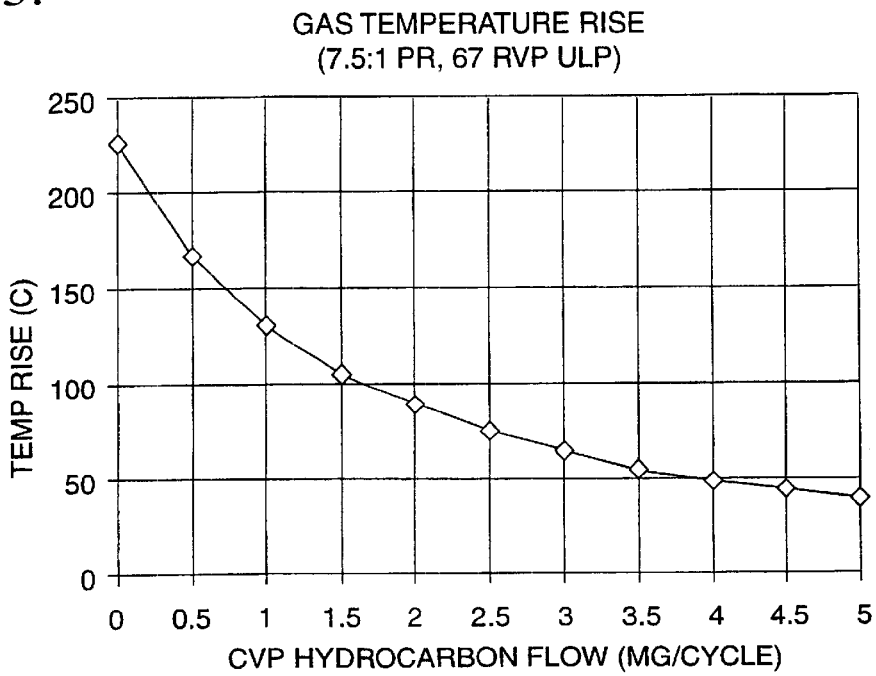
FIG. 3 is a graph showing the calculated purged gas hydrocarbon flow as a function of the gas temperature rise.

Referring now to FIG. 3, it is evident that over the range of no purge fuel (CVP) hydrocarbon flow to a value of 2.5 mg/cycle, that the temperature is quite sensitive to changes in the mass flow. The average gain over this range is 70 C per mg per cycle. As the hydrocarbon ratio approaches 100% the mixture heat capacity asymptotes towards that of the purge fuel vapour and therefore the change in temperature becomes progressively less.

The actual temperature rise can be monitored by assuming the compressor intake to have a temperature equal to that of the engine intake air. The compressor delivery air can be monitored via a thermistor or suchlike fitted downstream of the compressor exhaust. The average temperature may be determined by either electronically filtering the temperature signal or by placing the sensor a reasonable distance away from the compressor exhaust. If the sensor does not have a high dynamic response there may in either case be no need for further dampening of the signal.

If it is considered that the inlet temperature variations are significant, rather than simply examine the temperature rise across the compressor 20, a non-linear compensation for intake temperature could be provided (either algorithm or map). Further, the method may be made adaptive such that it is able to compensate for changing characteristics of the compressor 20.

As alluded to hereinbefore, the compressor 20 does not produce a truly adiabatic compression process as there are heat losses to the surrounds from the compression chamber. The loss will depend on the temperature of the cylinder walls, head and piston. Also, the heat loss per cycle will be inversely proportional to the compressor speed. The effect of the former may be accounted for by monitoring the engine coolant temperature and a compensation factor may be added to the calibration of the engine Electronic Control Unit (ECU) determining the purge fuel mass flow rate. Similarly the speed effect may be mapped or calculated by the ECU.

Figure 4:
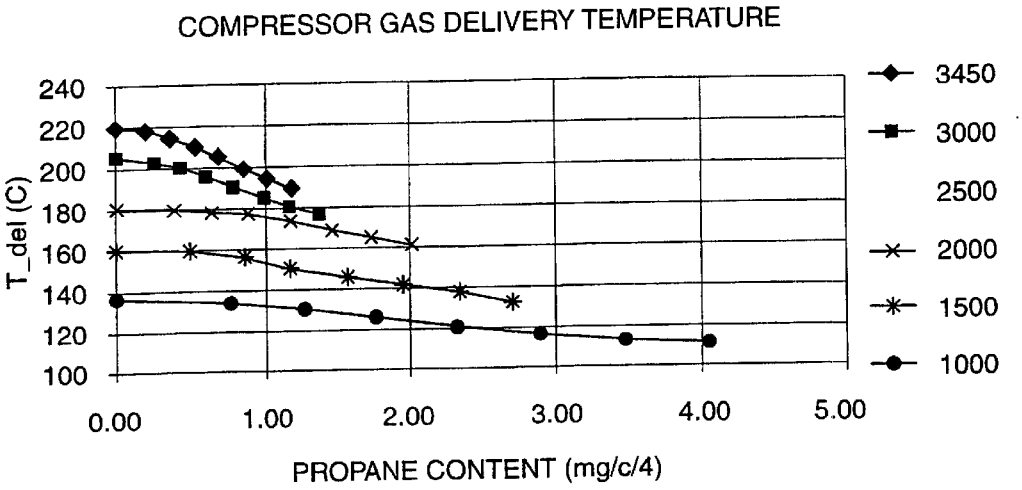
FIG. 4 is a graph based on actual test results showing the propane content of a purged gas flow as a function of compressor gas delivery temperature and compressor speed.
Figure 5:
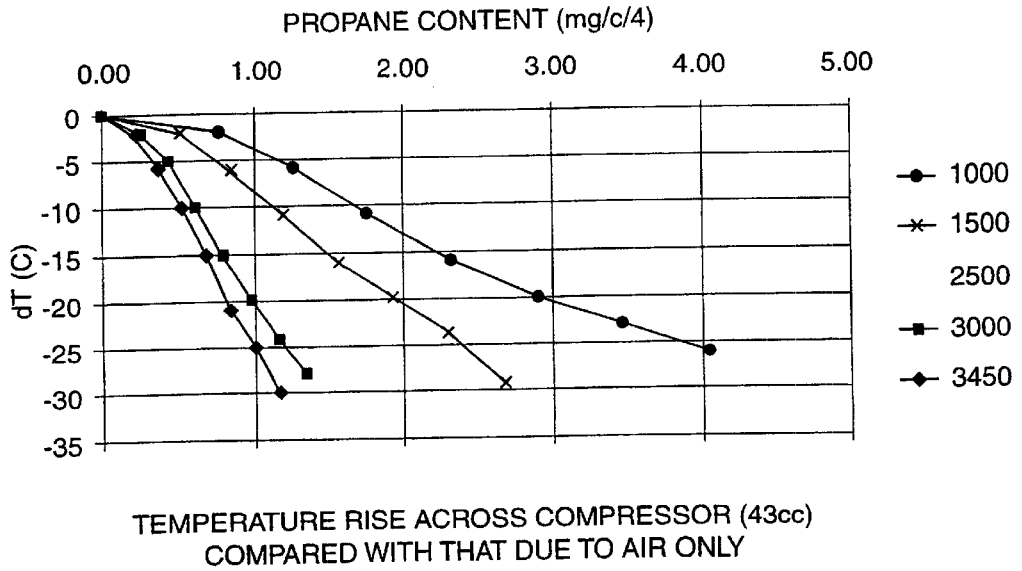
FIG. 5 is a graph based on actual test results showing the propane content of the purged gas as a function of the temperature rise across the compressor and the compressor speed.

FIGS. 4 and 5 are experimental plots which confirm the relationship of the delivery temperature from the compressor 20 and the hydrocarbon content of the gas being compressed. A series of plots are provided on each graph which show the effect of the compressor speed on the discharge temperature of the compressor 20. As can be seen in FIG. 4, the average delivery temperature increases as the compressor speed increases. The general relationship between the delivery temperature and the hydrocarbon content, with the delivery temperature decreasing with increasing hydrocarbon content, however remains the same.

In FIG. 5, which shows the temperature rise across the compressor 20 due to the compression of fuel vapour compared with the temperature rise due to the compression of air only, an increasing propane content clearly results in an increase in the temperature difference. Furthermore, an increase in compressor speed also results in a greater temperature difference for the same propane content than when the compressor 20 is operating at lower speeds.

The method according to the present invention provides for a simple and reliable method for determining the mass flow rate of purged gas being supplied to the fuel injection system on the basis of the adiabatic temperature rise of the gas delivered by the compressor 20. Furthermore, this method can be used under most if not all engine conditions, and not only when the engine is undergoing closed loop fuelling control. That is, the method is effectively able to provide closed loop fuel vapour purge control over all engine operating conditions.

Further, the method may be adaptable so as to account for any variations that may arise which may otherwise effect the accuracy of the determination of the purge fuel mass flow rate. For example, and as alluded to hereinbefore, compensation may be performed in light of compressor heat losses, compressor speed variations, changes in the discharge temperature of the compressor or air inlet temperature variations, or also or alternatively in respect of any purge gas which is recirculated through the compressor due to any air pressure regulation which may be performed by a related fuel injection system. Similarly, the method can be arranged to compensate for any variances in the PR value, created for example, by throttling of the intake of the air compressor. Such compensation can be achieved, as mentioned previously, by way of measuring or calculating the change in the compressor pressure ratio due to varying degrees of throttling of the compressor intake.

The above description is provided for the purposes of exemplification only and it will be understood by a person skilled in the art that modifications and variations may be made without departing from the invention.

What is claimed is:

1. A method for determining a purge fuel mass flow rate from a fuel vapour control system to an internal combustion engine having a compressor for delivering purge gas from the fuel vapour control system to the engine, the method including:

determining the temperature rise of the purge gas passing through the compressor;

determining the specific heat ratio of the purge gas as a function of the temperature rise; and determining the purge fuel mass flow rate as a function of the specific heat ratio of the purge gas.

2. A method according to claim 1, wherein the fuel vapour control system includes an air/fuel separation means for collecting fuel vapour generated within the engine, the compressor delivering purge gas from the air/fuel separation means to the engine.

3. A method according to claim 1, wherein the specific heat ratio of the purge gas is determined by the following equation:

$$T_{OUT} = T_{IN} \times PR^{k}\left(\frac{C_p / C_v}{(C_p / C_v - 1)}\right)$$

where $T_{OUT}$ is the compressor discharge temperature;

$T_{IN}$ is the compressor inlet temperature;

PR is the pressure ratio across the compressor;

$C_p/C_v$ is the Specific Heat Ratio for the purge gas; and

K is a compressor constant.

4. A method according to claim 3, including providing a compensation factor to account for the effect of heat losses of the compressor by monitoring the coolant temperature of the engine and adding said compensation factor to the said determination.

5. A method according to claim 4, wherein the compensation factor is the difference in the coolant temperature between a predetermined nominal value and the actual coolant temperature at current engine operating conditions, said difference being added as the compensation factor.

6. A method according to claim 4, wherein the compressor discharge temperature is measured by a temperature sensor located downstream of a discharge part of the compressor.

7. A method according to claim 3 including providing a compressor speed compensation factor to account for the effect of the change in heat losses of the compressor as a function of the speed of the compressor.

8. A method according to claim 3, including providing a discharge temperature compensation factor to account for the change in the compressor discharge temperature as a function of the speed of the compressor.

9. A method according to claim 3, wherein the compressor inlet temperature is taken to be equal to the temperature of the air at an intake of the engine.

10. A method according to claim 9, including providing a non-linear compensation factor for the intake temperature to account for inlet temperature variations.

11. A method according to claim 1, including comparing the purge fuel mass flow rate when the engine is operating under closed loop fuelling control with the determined purge fuel mass flow rate, and adjusting the determination method as required.

12. A method according to claim 1, wherein the compressor is arranged to supply compressed air to a dual fluid fuel injection system.

13. A method according to claim 1, including providing an air pressure regulation compensation factor to account for any purge gas delivered by the compressor which may be recirculated back to an intake thereof.

14. A method as claimed in claim 1, further including a pressure ratio compensation factor to account for any changes in the pressure ratio across the compressor.

15. A method as claimed in claim 14 wherein the changes in the pressure ratio across the compressor are due to throttling of the compressor inlet.

16. A method as claimed in claim 15 wherein the pressure ratio compensation factor is determined by comparing the pressure at the compressor inlet with the pressure downstream of the compressor.

17. A method as claimed in claim 15 wherein the pressure ratio compensation factor is determined by comparing particular degrees of throttling with a mapped look up table.

* * * * *

UNITED STATES PATENT AND TRADEMARK OFFICE

CERTIFICATE OF CORRECTION

PATENT NO. : 6,446,618 B1
DATED : October 15, 2002
INVENTOR(S) : Messing et al.

It is certified that error appears in the above-identified patent and that said Letters Patent is hereby corrected as shown below:

Column 4,
Line 48, replace "$P_k$:=arg" with -- $p_k$:=arg --.

Column 5,
Line 51, replace "assumption" with -- assumptions --.

Column 7,
Line 3, replace "un-noticed" with -- unnoticed --.

Column 10,
Line 13, replace "lets" with -- let's --.

Signed and Sealed this

Twenty-eighth Day of October, 2003

JAMES E. ROGAN
*Director of the United States Patent and Trademark Office*